United States Patent [19]

Hochwalt

[11] 4,035,845

[45] July 19, 1977

[54] PROTECTIVE FLIGHT HELMET

[75] Inventor: John R. Hochwalt, Green County, Ohio

[73] Assignee: The United States of America as represented by the Secretary of the Air Force, Washington, D.C.

[21] Appl. No.: 724,050

[22] Filed: Sept. 16, 1976

[51] Int. Cl.[2] ..... A42B 3/00

[52] U.S. Cl. ..... 2/6

[58] Field of Search ..... 2/6, 414, 415, 410, 2/423, 425

[56] References Cited

U.S. PATENT DOCUMENTS

| | | | |
|---|---|---|---|
| 1,691,202 | 11/1928 | La Van | 2/6 |
| 3,005,203 | 10/1961 | Aileo | 2/423 |
| 3,108,282 | 10/1963 | Rehman et al. | 2/6 |
| 3,148,376 | 9/1964 | Aileo | 2/6 |
| 3,591,863 | 7/1971 | Rickard | 2/415 |
| 3,609,764 | 10/1971 | Morgan | 2/414 |
| 3,726,620 | 4/1973 | Morton | 2/410 X |
| 3,786,519 | 1/1974 | Aileo | 2/6 |
| 3,852,821 | 12/1974 | Mickel | 2/415 |
| 3,882,547 | 5/1975 | Morgan | 2/414 |

*Primary Examiner*—Alfred R. Guest

*Attorney, Agent, or Firm*—Joseph E. Rusz; Richard J. Killoren

[57] ABSTRACT

A helmet, for flight personnel, having a conventional custom-molded energy absorbing liner member with a penetration resistant mid-liner member covering the energy absorbing liner. A leather outer cover fits over the mid-liner member. A visor is secured to the helmet with a stretch type material. Earphone earcups are secured to the inner surface of the leather cover by means of hook and loop fasteners. An impact protection material is secured to the leather cover with hook and loop fasteners at a position corresponding to the nape area of the wearer.

6 Claims, 20 Drawing Figures

Fig-9
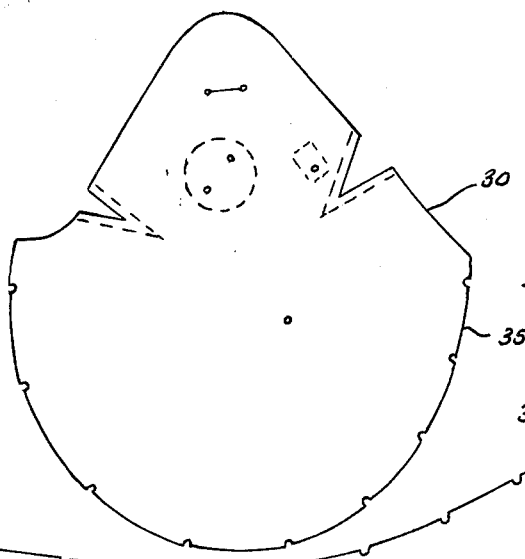
Fig-10
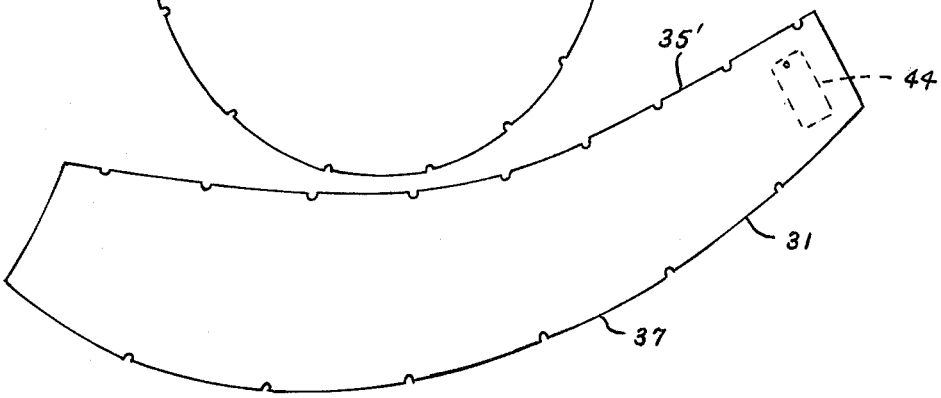
Fig-11
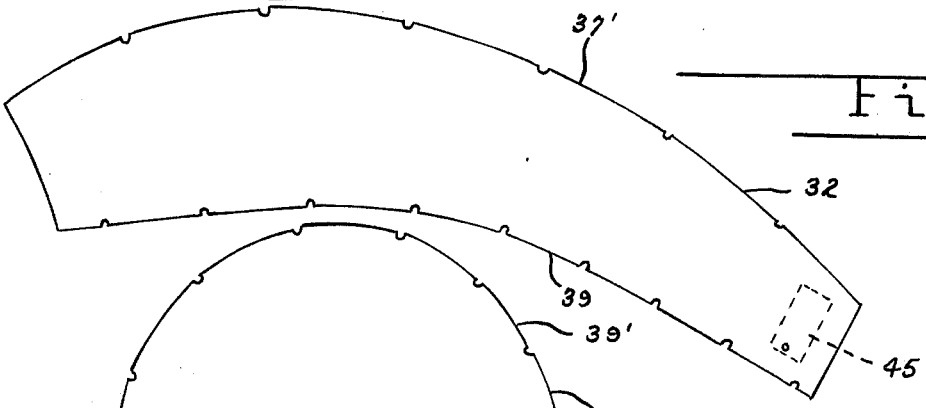
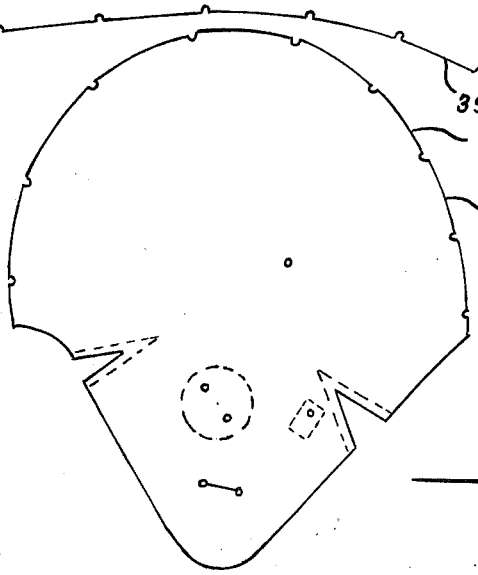
Fig-12

PROTECTIVE FLIGHT HELMET

RIGHTS OF THE GOVERNMENT

The invention described herein may be manufactured and used by or for the Government of the United States for all governmental purposes without the payment of any royalty.

BACKGROUND OF THE INVENTION

This invention relates to a protective flight helmet for use by pilots.

To prevent fatigue and to permit unencumbered movement by flight personnel, it is necessary to provide equipment which will give the needed protection with a minimum weight and which is not so bulky as to restrict the movement of the flight personnel.

A standard helmet used by pilots has a custom molded inner liner member which fits in a hard shell helmet. The liner member is made in a manner similar to that described in the patent to Morton, U.S. Pat. No. 3,762,620.

The standard helmet, with visor but without the oxygen mask, weighs approximately 3 pounds. It is desirable to reduce the weight of the helmet for the convenience and comfort of the flight personnel. It is also desirable to reduce the offset height, that is the distance between the crown of the head and the top of the helmet-visor assembly, to permit greater clearance for head movement.

BRIEF SUMMARY OF THE INVENTION

According to this invention, the weight of the helmet is substantially reduced by providing a protective shell over the standard polyurethane foam liner and by covering the shell and liner with a leather cover. Fabric straps with stretchable inserts are used to attach the visor to the leather cover. Hook and loop fasterners are provided to secure the earphone earcups to the leather cover and to secure impact protection material to the inner surface of the leather cover at a position corresponding to the nape area of the wearer.

IN THE DRAWINGS

FIGS. 9–14 show patterns for parts used in making the cover member for the device of FIGS. 1 and 2.

DETAILED DESCRIPTION OF THE INVENTION

Figure 1:
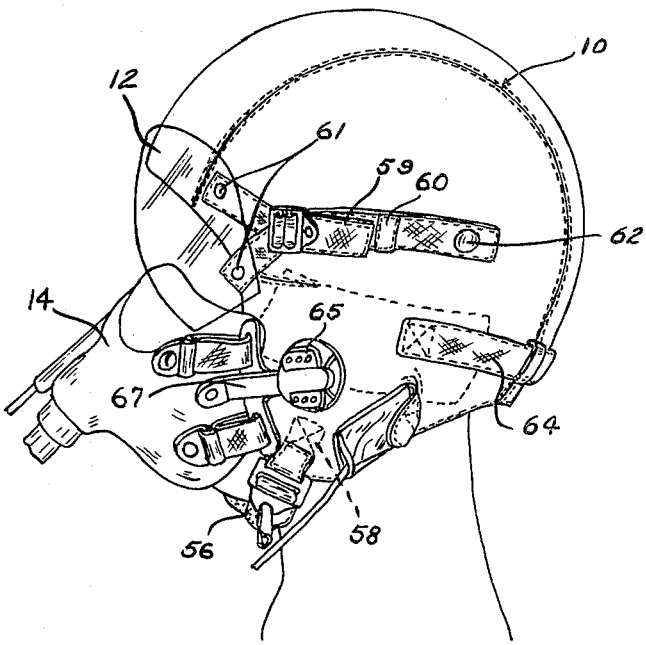
FIG. 1 is a side view of a flight personnel helmet according to the invention.
Figure 2:
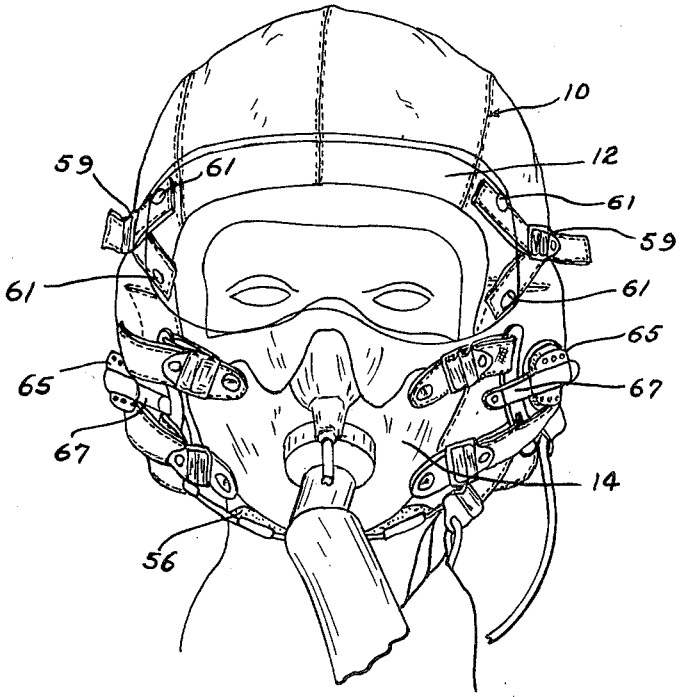
FIG. 2 is a front view of the device of FIG. 1.
Figure 3:
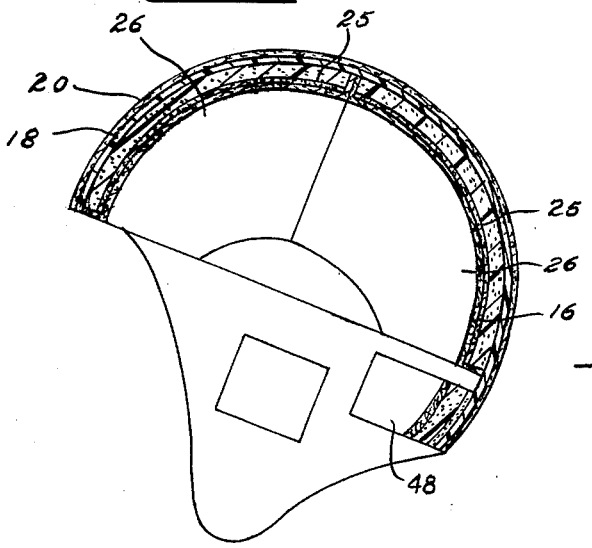
FIG. 3 is a sectional view of the device of FIG. 2 with mask and visor removed.

Reference is now made to FIG. 1 of the drawing which shows a helmet 10 for flight personnel. A visor 12 and an oxygen mask 14 are attached to the helmet 10. The helmet 10 includes a prior art energy absorbing custom-molded rigid liner member 16, a penetration resistant mid-liner 18 and an outer cover 20, as shown in FIG. 3.

Figure 4:
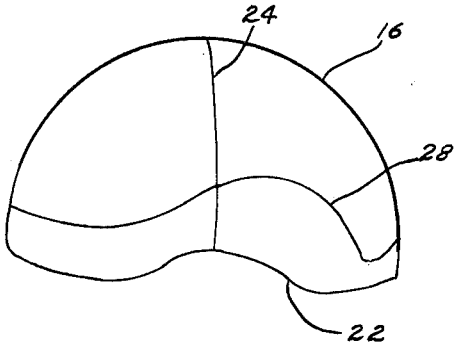
FIG. 4 is a side view of the inner liner for the device of FIG. 1.
Figure 5:
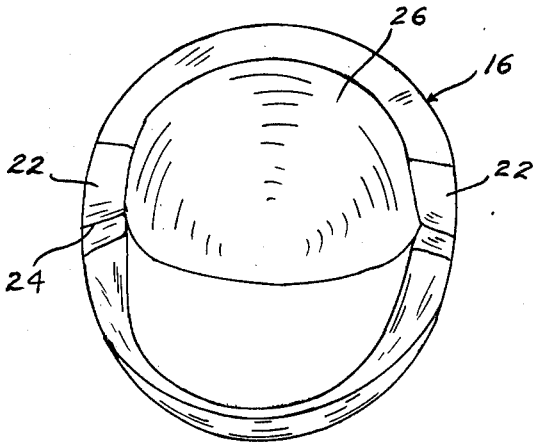
FIG. 5 is a bottom view of the device of FIG. 4.
Figure 6:
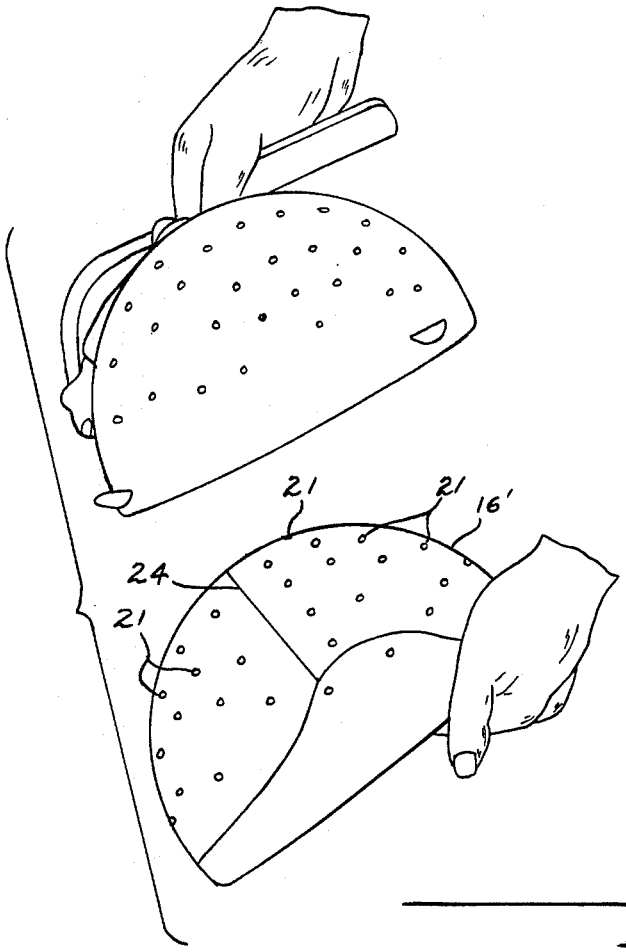
FIG. 6 shows the mold used to make the inner liner of FIGS. 4 and 5 with the inner liner being removed from the mold.

The inner liner member 16, shown in greater detail in FIGS. 4 and 5, is made in a standard mold. After removal from the mold, as shown in FIG. 6, the excess foam 21 is removed and two cutouts 22 are made to provide for the communication earcups and the liner member is cut at 24 to permit the securing of foam padding 25 and comfort leather layer 26 with a contact adhesive. The two parts of the liner are then joined with an adhesive. This liner is substantially the same as used with the prior art helmet except that the prior art liner is cut along line 28.

Figure 7:
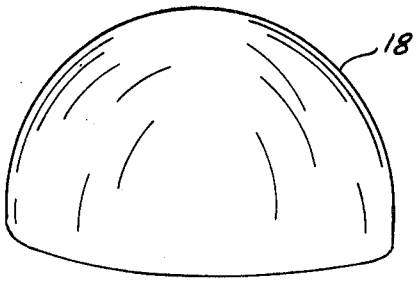
FIG. 7 is a side view of the mid-liner for the device of FIG. 1.
Figure 8:
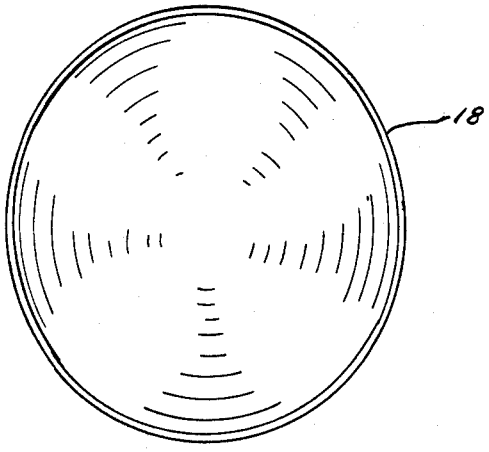
FIG. 8 shows a bottom view of the device of FIG. 7.
Figure 13:
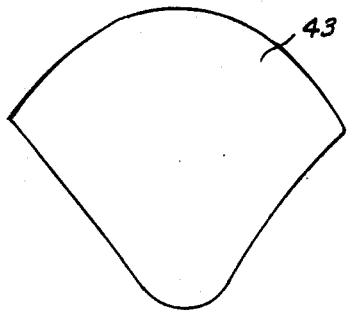
Figure 14:
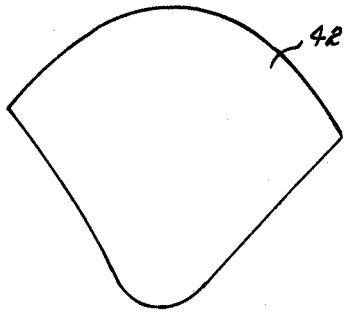

The mid-liner 18, shown in greater detail in FIGS. 7 and 8, is made by using liner 16 as a mold. After removing excess foam 21 from the liner 16', the liner is sanded smooth. The liner is then covered with a layer of fiberglas with an epoxy binder. The binder used was 2D Furane epoxy resin with 9810 hardener. After curing the surface is sanded smooth to the approximate dimensions of the outer surface of the poured liner.

The liner 16' is then used as a mold in the fabrication of the mid-liner 18. An epoxy release agent is applied to the outer surface of the prepared liner 16' to facilitate removal of the mid-liner after curing. The release agent used was mold shell release compound made by the Thread-Rite Corporation.

Figure 15:
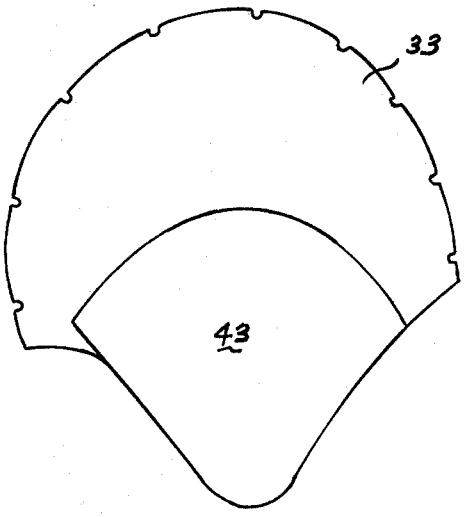
FIGS. 15–16 show the reinforcement parts secured to the cover member.
Figure 16:
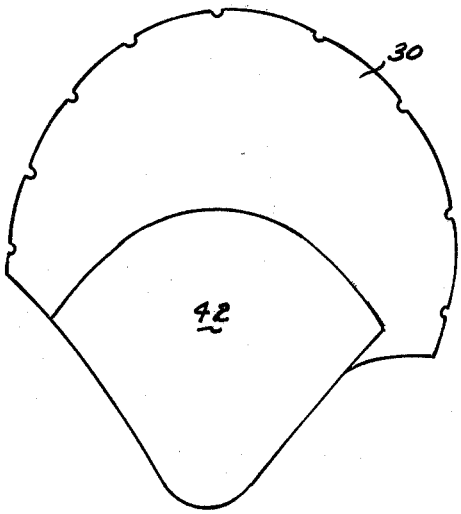
Figure 17:
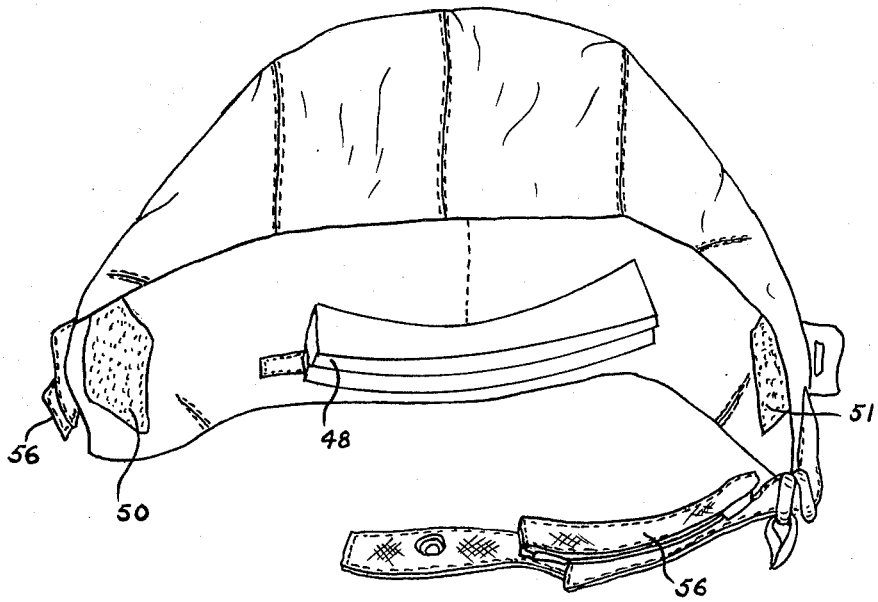
FIG. 17 shows a front isometric view of the cover member of FIGS. 1 and 2.
Figure 18:
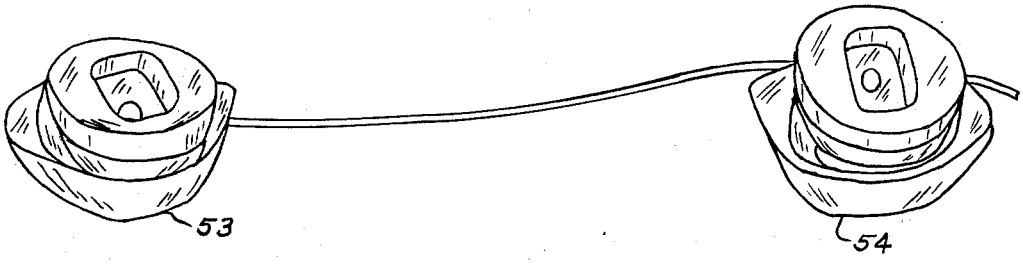
FIG. 18 shows the earcups for the communication system used with the helmet of FIGS. 1 and 2.

Three layers of fiberglas with an epoxy binder are then formed over the mold. After curing and trimming, the mid-liner is removed from the liner mold member 16'. This mid-liner member will then fit any liner 16 made from the same mold as shown in FIG. 6. One fabric used for making the mid-liner 18 was No. 181 fiberglas cloth. The binder used was the epoxy resin with hardener decribed above. Other fabrics and binders could also be used. Kevlar fabric with the same epoxy resin has been used for some mid-liners. The outer cover 20 is made by cutting parts 30, 31, 32 and 33, as shown in FIGS. 9, 10, 11 and 12, from a piece of hair sheep leather. Parts 30 and 31 are sewed together along edges 35 and 35'. Parts 31 and 32 are sewed together along edges 37 and 37'. Parts 32 and 33 are sewed together along edges 39 and 39'. Reinforcement panels 42 and 43, of a material such as Kevlar cloth, are secured to the inner surface of leather material 30 and 33 with a contact adhesive as shown in FIGS. 15 and 16. Velcro loop material is sewn to the inner surface of the cover, as shown at 44 in FIG. 10 and 45 in FIG. 11, to support impact protection material 48, shown in FIG. 17. Velcro loop material patches 50 and 51 are sewn to the inner surface of cover 20 to support the communication earcups 53 and 54 shown in FIG. 18.

Chin strap 56 is secured to the cover 20 as shown at 58. The visor 12 is secured to the cover 20 by means of fabric straps 59 with elastic inserts 60. The straps 59 are secured to visor by snaps 61 and to the cover 20 by snaps 62, one of which is shown in FIG. 1. A fabric adjustment strap 64 is secured to the back of the cover 20. Bayonet receivers 65 are bolted to the sides of the cover 20 to receive the bayonet retainers 67.

Figure 19:
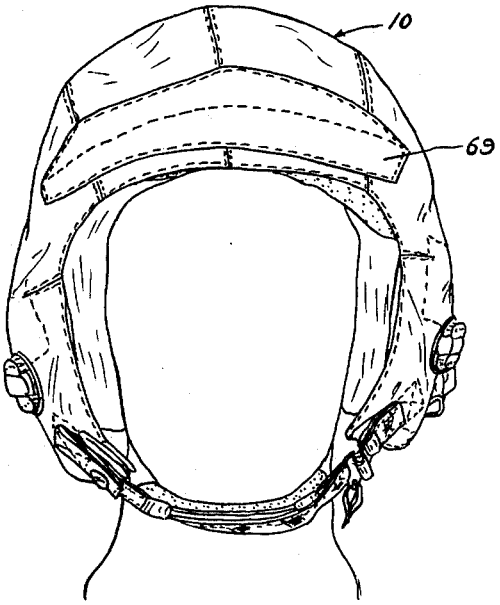
FIG. 19 shows a modification of the device of FIGS. 1 and 2.
Figure 20:
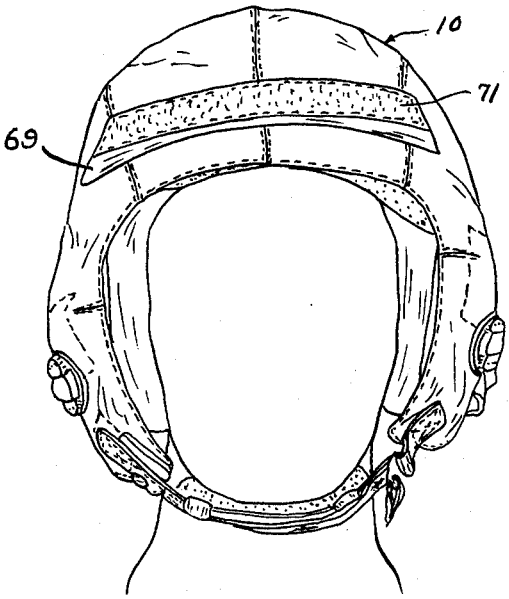
FIG. 20 shows the device of FIG. 19 with the flap turned up.

Though not used on all of the helmets, a visor support flap 69 is secured to some of the covers 20 as shown in FIG. 19. Velcro pile loop material 71 is secured to the underside of flap 69 as shown in FIG. 20. Velcro hook material, not shown, can then be provided across the top of visor 12. This provides added support for the visor.

There is thus provided an improved helmet for flight personnel which is lighter than prior art helmets and which reduces the offset height of the helmet.

I claim:

1. A helmet for flight personnel, comprising: a rigid energy absorbing liner member, adapted to conform to the head of the wearer; a penetration resistant mid-liner member covering the energy absorbing liner member; a helmet cover over said mid-liner member; said cover being made of a substantially non-stretchable flexible material; a chin strap secured to said helmet cover; a visor member; means for supporting said visor member on said helmet cover; a pair of communication earcups; means for securing said earcups to the internal surface of said helmet cover; an impact protection pad; means for securing the impact protection pad to the helmet cover at a position adapted to be placed adjacent the nape area of the wearer.

2. The device as recited in claim 1 wherein said mid-liner is made of fiberglas cloth with an epoxy resin binder.

3. The device as recited in claim 2 wherein said non-stretchable material is hair sheep leather.

4. The device as recited in claim 3 wherein said visor is supported on said helmet cover with fabric straps; said fabric straps including elastic inserts.

5. The device as recited in claim 4 wherein said helmet cover includes a visor support flap positioned to extend across the top of the visor; means for securing the top of said visor to said support flap.

6. The device as recited in claim 4 wherein said communication earcups and said impact protection pads are secured to the helmet cover with hook and loop fasteners.

* * * * *